US008814399B2

(12) United States Patent
Osawa et al.

(10) Patent No.: US 8,814,399 B2
(45) Date of Patent: Aug. 26, 2014

(54) LUMINAIRE HAVING RADIATOR

(75) Inventors: Shigeru Osawa, Yokosuka (JP); Takeshi Osada, Yokosuka (JP)

(73) Assignee: Toshiba Lighting & Technology Corporation, Kanagawa (JP)

( * ) Notice: Subject to any disclaimer, the term of this patent is extended or adjusted under 35 U.S.C. 154(b) by 0 days.

(21) Appl. No.: 13/497,101

(22) PCT Filed: Jul. 5, 2011

(86) PCT No.: PCT/JP2011/065357

§ 371 (c)(1),
(2), (4) Date: Mar. 8, 2013

(87) PCT Pub. No.: WO2012/005243

PCT Pub. Date: Jan. 12, 2012

(65) Prior Publication Data

US 2013/0155701 A1 Jun. 20, 2013

(30) Foreign Application Priority Data

Jul. 5, 2010 (JP) ..... 2010-153439

(51) Int. Cl.
*F21V 7/00* (2006.01)

(52) U.S. Cl.
USPC ..... 362/382; 362/655; 362/365

(58) Field of Classification Search
USPC ..... 362/249.01, 249.02, 235, 665, 365, 382
See application file for complete search history.

(56) References Cited

U.S. PATENT DOCUMENTS

2005/0225939 A1 10/2005 Otsuki et al.

FOREIGN PATENT DOCUMENTS

| | | |
|---|---|---|
| CN | 201407619 Y | 2/2010 |
| JP | 2005-303015 | 10/2005 |
| JP | 2009-064636 | 3/2009 |
| JP | 2010-103028 | 5/2010 |

OTHER PUBLICATIONS

Masaru et al., Japanese Patent Application Publication 2009-064636, Mar. 2009, machine translation.*
Hiramatsu et al., Japanese Patent Application Publication2010-103028,May 2010, machine translation.*
International Search Report for application No. PCT/JP2011/065357 dated Oct. 18, 2011 (4 pages).
Translation of Chinese Office Action, Application No. 201180003889.3 dated Aug. 22, 2013.

* cited by examiner

*Primary Examiner* — Tracie Y Green
(74) *Attorney, Agent, or Firm* — Patterson & Sheridan LLP

(57) ABSTRACT

A luminaire 1 of an embodiment has a radiator 3 which comes into surface-contact with a cap abutment surface 6C of a lamp unit 6 and conducts and radiates heat generated by the lamp unit 6, and a terminal board 7 which is attached to the upper side of the radiator 3 on the lateral outside of the cap abutment surface 6C.

9 Claims, 10 Drawing Sheets

LUMINAIRE HAVING RADIATOR

TECHNICAL FIELD

An embodiment of the present invention relates to a luminaire which includes a light source having a semiconductor light emitting device such as light emitting diode (LED).

BACKGROUND ART

In the related art, a luminal re such as a down light has been commercialized which includes a light source having a semiconductor light emitting device such as an LED and is used, for example, in a state of being embedded and installed in a ceiling or the like.

Such a luminaire includes a lamp unit which has a light source and a turn-on circuit required for turning and driving the light source, a radiator for conducting and radiating heat generated by the lamp unit, and a terminal board which is provided in the radiator and to which a power source cable or the like for supplying a power source to the turn-on circuit is connected.

In recent years, in such a luminaire, a higher output of the light source such as an LED has been in progress. When increasing the electric power so as to promote the higher output of the light source, the temperature of the lamp unit itself rises along with the heating of the LED. The higher the electric power of the luminaire is, the higher the temperature of the lamp unit is, whereby the temperature of the radiator, to which heat generated by the lamp unit is conducted, also increases in proportion to the temperature of the lamp unit.

For this reason, to deal with the heat radiation caused by the higher output, a configuration is considered which increases an amount of heat conducted from the lamp unit to the radiator by increasing a contact surface between the lamp unit and the radiator, and raises heat radiation efficiency of the radiator. However, when increasing the contact area between the lamp unit and the radiator, as the temperature of the lamp unit becomes higher, the temperature of the radiator also rapidly rises.

Then, since heat from the radiator is conducted to a power source cable or the like required for lighting via the terminal board attached to the radiator, it is impossible to secure sufficient tolerance of the power source cable or the like depending on the temperature of the transmitted heat.

In general, the terminal board attached to the radiator, the power source cable connected to the terminal board or the like has the heat resistance of a predetermined given heat-resistant temperature, respectively. However, particularly, in a case where the temperature of heat transmitted from the radiator via the terminal board exceeds the heat-resistant temperature of the power source cable (for example, 70° C.), the tolerance of the power source cable important for the turn-on operation cannot be sufficiently secured, and as a consequence, a normal turn-on state cannot be maintained. For this reason, there is a need to protect the power source cable connected to the terminal board from heat.

However, in the luminal re of the related art, in a case where the temperature transmitted from the radiator to the power source cable or the like via the terminal board becomes higher than the heat-resistant temperature of the power source cable along with the higher output, there is a problem that it is difficult to secure the sufficient tolerance of the power source cable, that is, the power source cable connected to the terminal board cannot be sufficiently protected from heat.

Thus, the present embodiment has been made in view of the above problems, and an object thereof is to provide a luminaire which is able to protect the power source cable connected to the terminal board from heat by insulating the heat conducted from the radiator to the terminal board.

SUMMARY OF INVENTION

Solution to Problem

A luminaire of the embodiment has a radiator which comes into surface-contact with an abutment surface of a lamp unit, and conducts and radiates heat generated by the lamp unit; and a terminal board which is attached to an upper side of the radiator on the lateral outside of the abutment surface.

DESCRIPTION OF EMBODIMENTS

Figure 1:
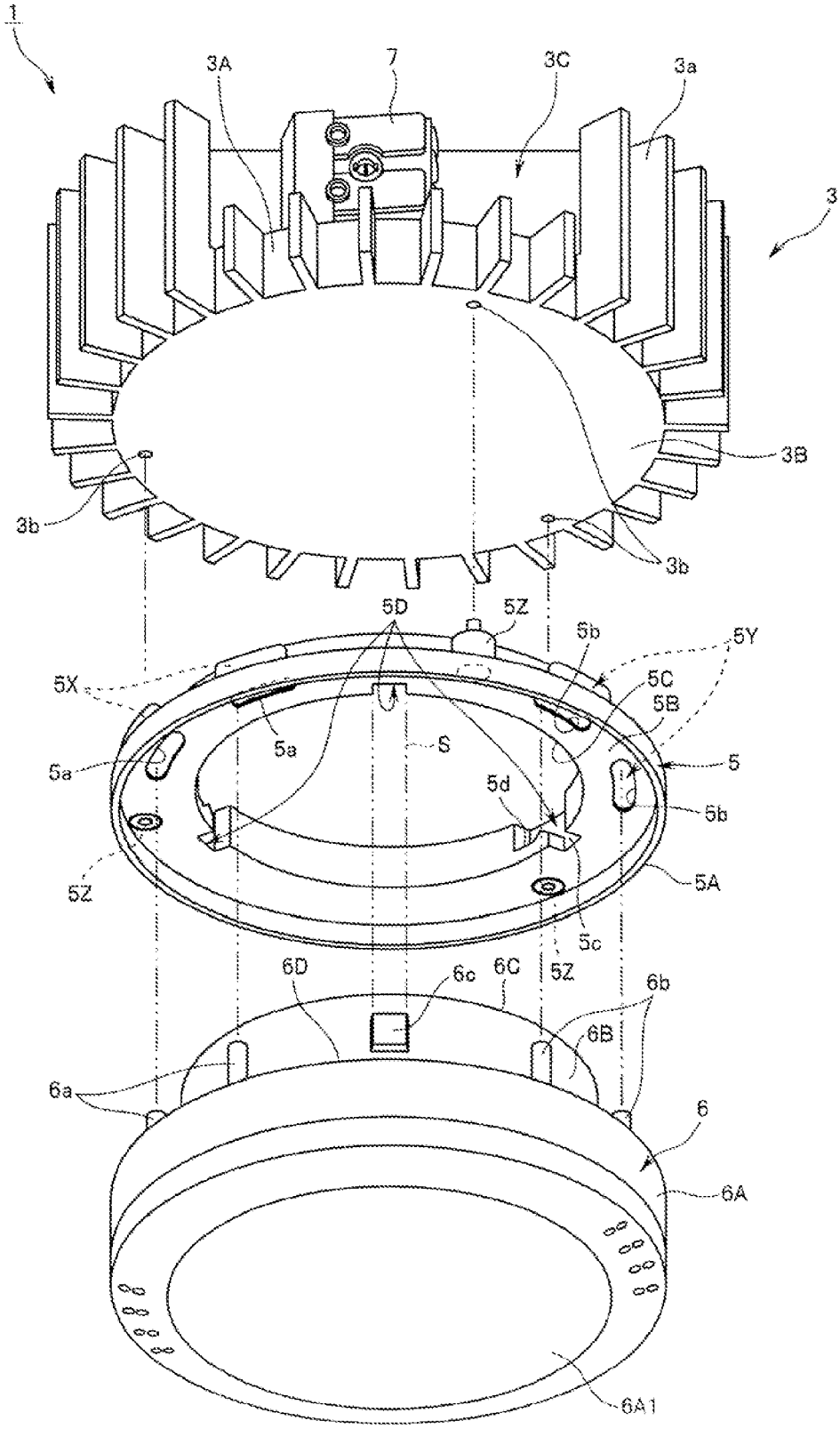
FIG. 1 is a perspective exploded diagram of a luminaire according to an embodiment.

A luminaire of an embodiment includes a radiator which comes into surface-contact with an abutment surface of a lamp unit, and conducts and radiates heat generated by the lamp unit; and a terminal board which is attached to an upper side of the radiator on the lateral outside of the abutment surface.

In embodiments according to the present invention and each invention of the Claims mentioned below, unless otherwise limited, the definition and the technical meaning of terms are as below.

The lamp unit constitutes a lamp main body which includes a light source having a semiconductor light emitting device such as an LED, a turn-on circuit required for turning and driving the light source or the like, but is not limited thereto. In addition, as the semiconductor light emitting device, an organic EL device or the like can be used besides the LED.

The radiator conducts and radiates heat generated by the lamp unit. For example, the radiator is configured so as to come into contact with the lamp unit, specifically, to come into surface-contact therewith, but the configuration thereof is not limited to it. Heat generated by the lamp unit is heat which is generated by a light source such as an LED and is transmitted to a lamp unit main body, for example, when the lamp is turned on.

In a material of the radiator, as a metallic material having good thermal conductivity, for example, a die cast material using aluminum or the like is used. However, another metallic material may be used without being limited to the above.

Furthermore, the radiator is configured by radially providing a plurality of heat radiation fins on an outer periphery thereof but the form is not limited to it.

The terminal board is connected with, for example, a power source cable for power supply from the outside, a cable for dimming control or the like, and is connected with connection lines for power source supply which is extended from the lamp unit and dimming control, but the configuration thereof is not limited to the above. In addition, a material of the terminal board is constituted by a member having heat-resistance, for example, such as resin. As the heat-resistance of the terminal board, for example, a material of the heat-resistant temperature of 90° C. is used, but is not limited to it.

Furthermore, the attachment of the terminal board to the radiator is fixed, for example, by fitting a locking claw portion provided on an attachment surface of the terminal board, for example, into a locking hole in a support portion on a protrusion, provided in a main body of the radiator or a heat radiation fin, but without being limited to the above the terminal board may be fixed to the radiator using a screw. In this case, a gap, that is, a space portion is formed between the attachment surface of the terminal board and the radiator.

The luminaire of the embodiment has insulation means which insulates heat transmitted from the radiator, and the terminal board may be attached to the radiator via the insulation means.

The insulation means insulates heat transmitted from the radiator. That is, the insulation means is, for example, an air layer which is interposed between the radiator and the terminal board and insulates heat transmitted from the radiator to the terminal board, but is not limited to it.

In the luminaire of the embodiment the radiator is formed with a notch portion having a notch surface in which a part of an outer peripheral side thereof is notched, the notch surface of the notch portion has a protrusion-like support portion, the terminal board is configured so that the attachment surface is attached to the radiator via the protrusion-like support portion, and the insulation means may be a space portion which is formed between the notch surface of the radiator and the attachment surface of the terminal board by the support portion.

The protrusion-like support portion is provided on the notch surface in which a part of the outer peripheral side of the radiator is notched, that is, on the attachment surface of the radiator. It is preferred to provide at least two or more support portions. Moreover, the terminal board is attached to the radiator via the support portion, whereby the space portion constituting the insulation means is formed between the notch surface of the radiator and the attachment surface of the terminal board. Of course, the support portion itself may be configured as the insulation member.

Since the terminal board is attached to the notch surface of the outer peripheral side in which the temperature of the radiator is lowered via the support portion by such a configuration, by forming the space portion which is the insulation means, it is possible to insulate heat transmitted from the radiator to the terminal board and protect the power source cable connected to the terminal board from heat.

The support portion may be, for example, an insulation member, and the terminal board may be placed in a position of the outside of the outer periphery of the radiator in a cross section of the radiator of a direction perpendicular to an attachment direction of the lamp unit relative to the radiator and may be attached via the support portion so as to form an air layer.

An insulation member is formed in a plate shape, for example, by the use of resin, and the attachment of the insulation member, the terminal board and the radiator are fixed, for example, by the screwing using a screw, but the configuration is not limited to it. The terminal board is, by the insulating member, placed in a position of the outside of the outer periphery of the radiator and is fixed so that the air layer is formed. Thus, heat is hardly transmitted to the terminal board even by the embodiment mentioned above, and a more satisfactory insulation effect can be obtained. In addition, the shape and the length of the insulation member may be suitably changed as necessary.

By such a configuration, it is possible to more effectively improve the insulation effect by a simple configuration.

In the luminaire of the embodiment, the insulation means may be the space portion which forms a second air layer closer to a center side of the radiator than the notch surface of the radiator to which the terminal board is attached.

The space portion forms the second air layer closer to the center side of the radiator than the notch surface of the radiator to which the terminal board is attached, and is, for example, a rectangular groove portion. In addition, the space portion can be used in combination as an attaching space portion for being attached to the radiator using a locking claw, a screw or the like of the terminal board.

The insulation effect to the terminal board can be increased by the configuration.

In the luminaire of the embodiment, the insulation means may be an attachment portion which places the terminal board in a more outside position than the outer periphery of the radiator, and the terminal board may be attached to the radiator via the attachment portion.

In the luminaire of the embodiment, the groove portion may be an arc-shaped groove portion centered on the notch surface side.

Since the arc-shaped groove portion is formed so as to reduce a heat transfer path to the support portion to which the terminal board is attached, heat is hardly transmitted to the terminal board even by the embodiment mentioned above, and a more satisfactory insulation effect can be obtained.

With the configuration, the insulation effect can be more effectively improved by a simple configuration.

In the luminaire of the embodiment, the radiator may have an attachment portion to which the terminal board is attached at the outside from the center of the radiator of the notch surface, and the attachment portion may be fixed to the cross section of the radiator in a direction perpendicular to the attachment direction of the lamp unit relative to the radiator in a state where a bottom surface of the attachment portion comes into surface-contact therewith.

In the attachment portion, heat is not transmitted from the side, heat is transmitted only from the bottom surface, the heat transfer path can be reduced, heat is hardly transmitted to the terminal board even by the embodiment mentioned above, and a more satisfactory insulation effect can foe obtained. In addition, the attachment portion may be formed so as to be thinner than the thickness of the heat radiation fin 3*a*. As a result, the heat transfer path to the attachment portion can be further reduced.

With the configuration, the insulation effect can be more effectively improved by a simple configuration.

In the luminaire of the present embodiment, the radiator has a heat radiation main body which is formed to have substantially the same diameter as that of the lamp unit, and a plurality of heat radiation fins which is radially provided from the center of the heat radiation main body in the outer periphery of the heat radiation main body, and a holding portion, which holds the power source cable connected to the terminal board, may be provided in at least one or more heat radiation fins of the plurality of heat radiation fins.

With the configuration, in order to prevent the power source cable from coming into contact with a portion having a temperature higher than that, of a tip side of the heat radiation fin, specifically, near the center of the upper portion of the radiator, it is possible to protect the power source cable connected to the terminal board from heat of the radiator.

In the luminaire of the embodiment, the radiator has a wiring groove which is formed by notching a part of the heat radiation main body just below the terminal board and just above the power source socket portion of the lamp unit, and the terminal board and the power source socket portion are connected by a connection line via the wiring groove.

With the configuration, the connection line connects the terminal board and the power source socket portion through the outside of the radiator. In addition, since the terminal board and the power source socket portion can be connected in the shortest using the connection line via the wiring groove, it is possible to protect the connection, which connects the terminal board with the power source socket portion, from heat of the radiator.

Embodiment

The luminaire of the present embodiment will be described with reference to FIGS. 1 to 5.

Figure 2:
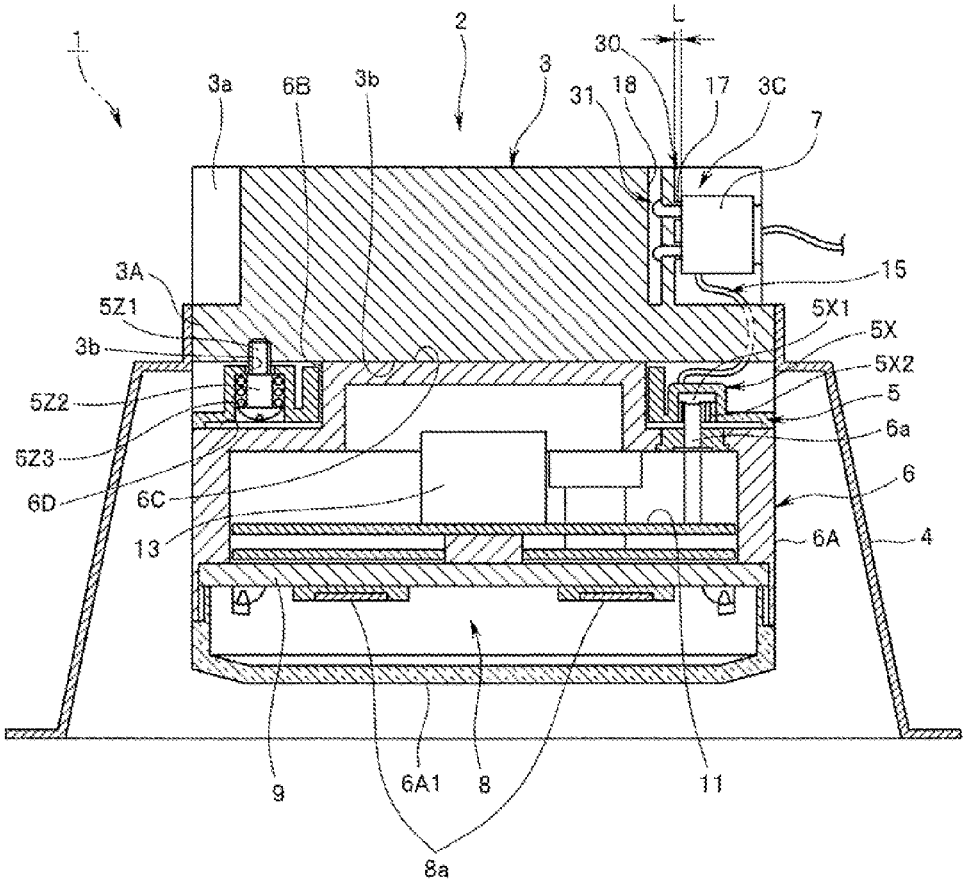
FIG. 2 is a cross-sectional view for describing an entire configuration of the luminaire of FIG. 1.

FIG. 1 is a perspective exploded diagram according to the present embodiment. FIG. 2 is a cross-sectional view for describing the overall configuration of the luminaire of FIG. 1.

As shown in FIGS. 1 and 2, a luminaire 1 is, for example, a down light, and includes an apparatus main body 2, a socket device 5 attached to the apparatus main body 2, and a lamp unit 6 which is freely attached to and detached from the socket device 5. In addition, hereinafter, a direction relationship of a vertical direction or the like will be described by setting a cap side to the upside and setting a light source side to the downside on the basis of a state of horizontally attaching the apparatus main body 2.

The apparatus main body 2 includes a radiator 3 and a reflector 4 (see FIG. 2) attached to the radiator 3. The reflector 4 is made of metal, is integrally formed with a reflection plate portion, and is formed in a circular shape. A diameter of the reflection plate portion is expanded toward the downside. In addition, a specific configuration of the radiator 3 will be described later.

The socket device 5 has a cylindrical socket main body 5A made of a synthetic resin having insulation property, and in a middle portion of the socket main body 5A, a fitting hole 5C is formed to penetrate in the vertical direction to which the cap portion 6B of the lamp unit 6 is fitted. On the lower surface of the socket device 5, a socket side abutment surface 5B is formed with which a cap side abutment surface 6D (see FIG. 2) of the lamp unit 6 comes into contact.

In a predetermined position of the socket side abutment surface 5B, two guide holes 5*a* into which a pair of power source cap pins 6*a* of the lamp unit 6 are inserted, respectively, and two guide holes 5*b* into which a pair of signal cap pins 6*b* of the lamp unit 6 are inserted, respectively, are formed.

Furthermore, on a surface (an upper surface) of an opposite side of the socket side abutment surface 3B, two power source socket portions 5X are provided to match with the positions of the two guide holes 5*a*, and two signal socket portions 5Y are provided to match with the positions of the two guide holes 5*b*.

A guide groove 5X1 (see FIG. 2) is formed along a circumferential direction in the inner portion of the power source socket portion 5X, and in the end portion of the guide groove 5X1, a cap pin receiving portion 5X2 is provided to which the power source cap pin 6*a* is electrically connected.

Furthermore, although it is not shown, a guide grove substantially the same configuration as that of the guide groove 5X1) is formed along the circumferential direction is also formed in the inner portion of the signal socket portion 5Y. In the end portion of the guide groove, a cap pin receiving portion (substantially the same configuration as that of the cap pin receiving portion 5X2) is provided to which the signal cap pin 6*b* is electrically connected.

In addition, the respective cap receiving portions 5X2 of the power source socket portion 5X and the respective cap receiving portions (not shown) of the signal, socket portion are connected to the terminal board 7 attached to the radiator 3 of the apparatus main body 2 via the connection line 15, respectively.

Furthermore, on the inside of the fitting hole 5C of the socket device 5, three guide portions 5D are provided with which three engagement portions 6C of the lamp unit 6 are engaged, respectively. The two guide portions 5D are placed in a position where a length of an inner peripheral surface of the fitting hole 5C in the circumferential direction is equally divided into three, respectively.

In the inner portions of the respective guide portions 5D, a guide hole 5*c* and a guide groove 5*d* are provided which guide the engagement portion 6C while being engaged therewith, respectively. The guide hole 5*c* is a hole which penetrates along a mounting direction of the lamp unit 6. The guide groove 5*d* is a groove which is extended to the guide hole 5*c* and has a slope along the circumferential direction of the fitting hole 5C.

The socket device 5 of the configuration is fixed to the bottom surface 3B of the radiator 3 constituting the apparatus main body 2 by three fixing portions 5Z so as to be freely moveable in the mounting direction of the lamp unit 6.

As shown in FIG. 2, the fixing portion 5Z has a screw portion 5Z1 which is screwed to the fixing hole 3*b* of the bottom surface 3B, a bearing portion 5Z2 which is inserted through the screw portion 5Z1, and a spring 5Z3 which always biases the bearing portion 5Z2 toward the bottom, surface 3B. That is, the socket device 5 is always pressed and fixed to the bottom surface 3B of the radiator 3 by the biasing force of the springs 5Z3 of the two fixing portions 5Z.

Meanwhile, the lamp unit 6 includes a unit main body 6A, a light emitting portion 8 having a plurality of LEDs 8*a* as the light source placed on the lower surface side of the unit main body 6A, a metallic mount substrate 9 to which the light emitting portion 8*a* is attached, a control substrate 11, a control device 13 provided in the control substrate 11, and a glove 6A1 covering the light emitting portion 8.

The entire unit main body 6A is formed of a die cast member using a metal having excellent heat radiation property, for example, aluminum or the like, and the upper portion thereof is formed with a cap portion 6B. Furthermore, on an abutment surface 6D formed between the cap portion 6B of the unit main body 6A and an outer peripheral portion, in a position matched with the guide holes 5*a* and 5*b* of the socket device 5, a pair of power source cap pins 6*a* and a pair of signal cap pins 6*b* are provided so as to protrude along the mounting direction of the lamp unit 6.

The plurality of LEDs 8*a* is mounted on the mount substrate 9, and the mount substrate 9 is attached to the attachment surface of an inner peripheral side step portion of the unit main body 6A in an adherence state. In the mount substrate 9, a wiring pattern is formed on the metallic substrate via the insulation layer, and the LED 8*a* is connected onto the wiring pattern and is attached so as to adhere to the attachment surface of the unit main body 6A by a plurality of screws or the like as heat transfer connection means.

The glove 6A1 is formed by a glass, a synthetic resin, or the like being transparent and having light transmitting property or having light diffusing property.

The control device 13 includes a DC-AC converter, a constant current circuit, a turn-on circuit such as a power source circuit, and a control circuit that controls the dimming of the LED 8*a* or the like. Although it is not shown, the control device 13 has a circuit board, and a control circuit component mounted on the circuit board. The power source cap pin 6*a* and the signal cap pin 6*b* are electrically connected with the input portion of the circuit board by a lead wire or the like, and the mount substrate 9 is electrically connected with the output portion of the circuit board by the lead wire or the like.

Furthermore, when the lamp unit 6 is attached to the socket device 5 fixed to the radiator 3, the cap abutment surface 6C of the lamp unit 6 is fixed in the state of coming into surface-contact with the bottom surface 3B of the radiator 3.

When attaching the lamp unit 6 to the socket device 5, the engagement portion 6*c* of the lamp unit 6 is moved while being engaged along the guide groove 5*d* of the guide portion 5D in the circumferential direction, whereby the cap abutment surface 6C of the lamp unit 6 is pushed up in the bottom 3B direction of the radiator 3. At the same time, the socket device 5 is temporarily moved in the direction separated from the bottom surface 3B of the radiator 3 against, the biasing force of the springs 5Z3 of the three fixing portions 5Z.

When the engagement portion 6*c* of the lamp unit 6 is further moved and reaches the fixed position placed in the end portion of the guide groove 5*d*, the socket device 5 is fixed in a position separated from the bottom surface 3B of the radiator 3 by a predetermined size. However, at the same time, the cap abutment surface 6C of the lamp unit 6 is fixed in the state of being pressed to the bottom surface 3B of the radiator 3 through the spring 5Z3 by predetermined pressing force and coming into surface-contact therewith.

Thus, in the luminaire 1 of the present embodiment, when the lamp is turned on, as shown in FIG. 2, heat generated by the LED 8*a* in the lamp unit 6 is transmitted to the mount substrate 9 and the unit main body 6A, and then is effectively transmitted to the bottom surface 3B of the radiator 3 with which the cap abutment surface 6C of the unit main body 6A comes into surface-contact. In the case of the luminaire 1 of the high output, the amount of heat transmitted from the lamp unit 6 to the radiator 3 side is increased.

Next, a configuration of the radiator 3 to which heat from the lamp unit 6 is transmitted, and an attachment structure of the terminal board 7 fixed to the radiator 3 will foe described using FIGS. 1 to 5.

Figure 3:
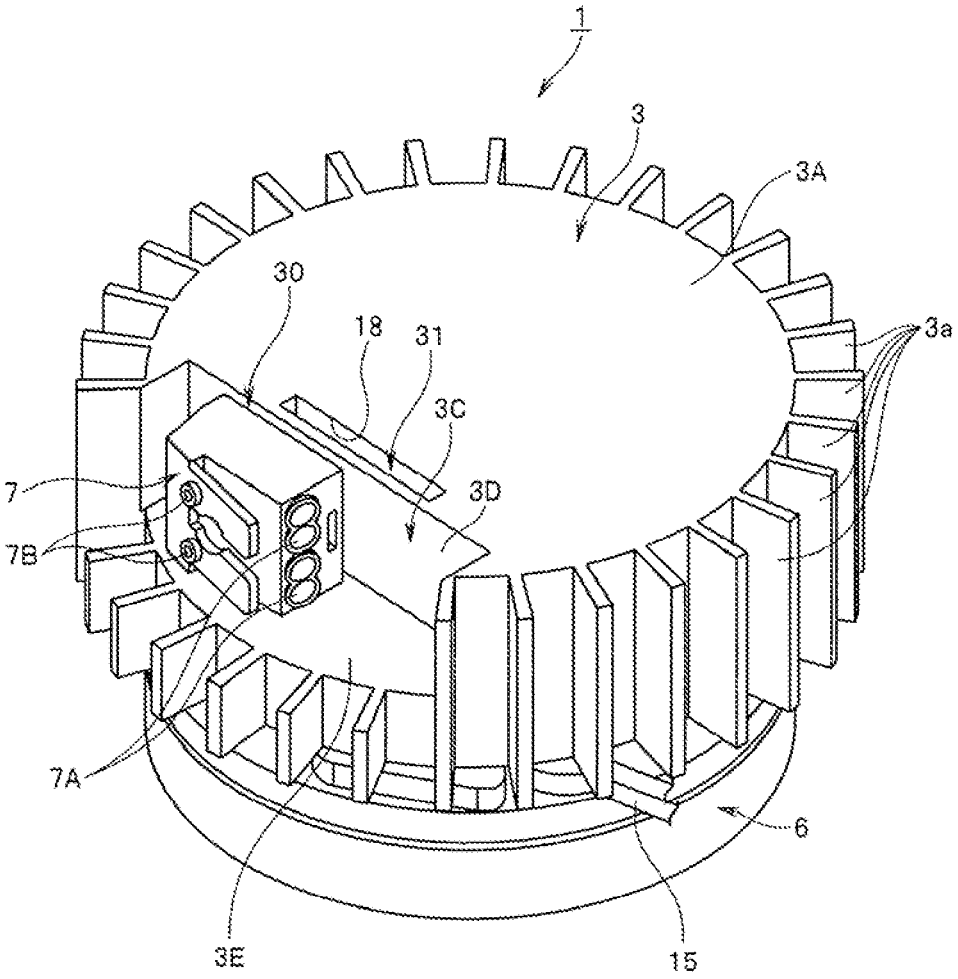
FIG. 3 is a perspective view of the luminaire of a state where a terminal board is attached to a radiator.
Figure 4:
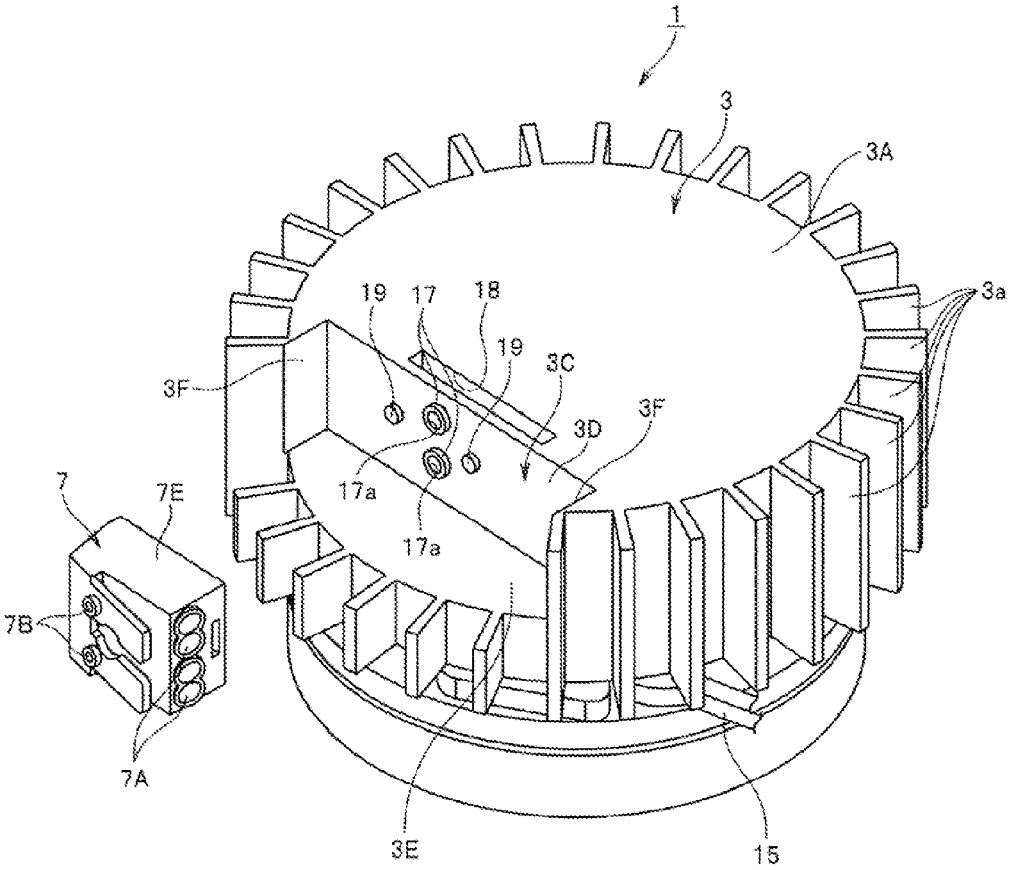
FIG. 4 is a perspective view for describing a configuration of a notch portion and a support portion of the radiator to which the terminal board is attached.
Figure 5:
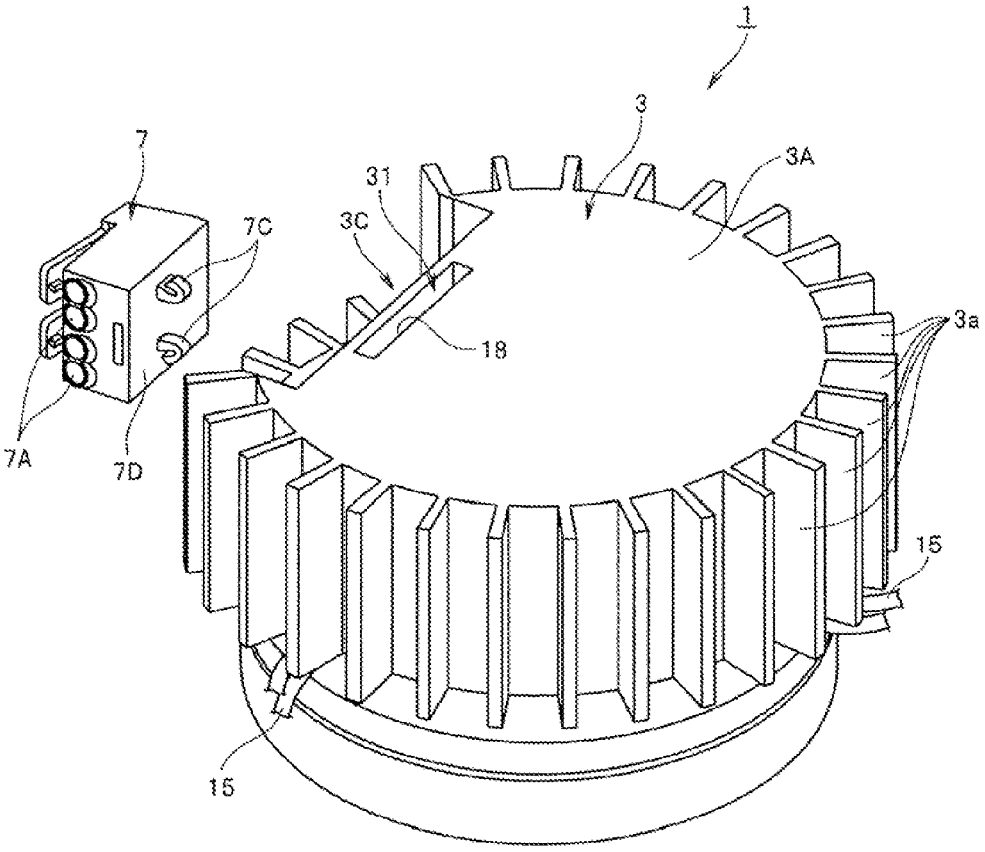
FIG. 5 is a perspective view for describing a configuration of the terminal board attached to the support portion of the radiator.

In addition, FIG. 3 is a perspective view of the state where the terminal board is attached to the radiator. FIG. 4 is a perspective view for describing a configuration of a notch portion and a support portion of the radiator to which the terminal board is attached. FIG. 5 is a perspective view for describing a configuration of the terminal board attached to the support portion of the radiator.

As shown in FIGS. 1 to 3, the entire radiator 3 is formed of a metal having excellent heat radiation property, for example, a die cast member using aluminum of the like, and includes a heat radiation main body 3A formed to have substantially the same diameter as that of the lamp unit 6, and a plurality of heat radiation fins 3*a* provided on the outer periphery of the heat radiation main body 3A radially from the center of the heat radiation main body 3A.

In the present embodiment, the radiator 3 comes into surface-contact with the cap abutment surface 6C of the lamp unit 6, and conducts heat generated by the lamp unit 6 to radiate heat. Furthermore, the radiator 3 has a configuration in which the terminal board 7 is attached to the upper side of the radiator 3 on the lateral outside of the cap abutment surface 6C.

Furthermore, the radiator 3 in the present embodiment conducts heat generated by the lamp unit 6 to radiate heat, and the temperature thereof is equal to or greater than 70° C. when the lamp unit 6 is turned on. Furthermore, a configuration is adapted in which the terminal board 7 is attached to the radiator 3 via insulation means that insulates heat transmitted from the radiator 3.

A specific attachment structure of the radiator 3 and the terminal board 7 will be described. The radiator 3 is configured to have the notch portion 3C in which a part of the outer peripheral side is notched in a cross section of the radiator 3 perpendicular to the attachment direction S of the lamp unit 6 relative to the radiator 3.

As shown in FIG. 4, the notch portion 3C is formed to have a first notch surface 3D facing the attachment surface 7D of the terminal board 7, a second notch surface 3E which is extended to the first notch surface 3D and is provided along a direction perpendicular to the attachment direction S of the lamp unit 6, and a pair of third notch surfaces 3F which is perpendicular to the first notch surface 3D and is placed to face the same.

Furthermore, the radiator 3 forms, for example, a rectangular groove portion 18 closer to the center side of the radiator 3 than the first notch surface 3D of the notch portion 3C. The groove portion 18 is an elongated groove formed to have an inner surface parallel to the first notch surface 3D. In addition, the groove portion 18 is a groove portion which does not penetrate between the upper surface of the radiator 3 in the vertical direction the attachment direction S of the lamp unit 6) and the bottom surface 3B, but without being limited to this may be formed so as to penetrate therebetween.

Moreover, the first notch surface 3D is formed with a pair of protrusion-like support portions 17 which protrudes in a direction perpendicular to the attachment direction S of the lamp unit 6. The pair of support portions 17 is, for example, placed along the vertical direction at predetermined intervals, and the attachment surface 7D of the terminal board 7 comes into contact with the plane of the tip of each protrusion portion to support the terminal board 7 in the fixed state. Furthermore, the pair of support portions 17 is provided with engagement holes 17*a* which are penetration holes penetrating through the groove portion 18. The engagement holes 17*a* are holes for inserting the locking claw portion 7C of the terminal board 7.

In addition, at both sides of the pair of support portions 17, two second support portions 19 are formed which are placed to match the size of the terminal board 7. The height of the second support portion 19 from the first notch surface 3D, that is, the protrusion amount is formed to have the same height as that of the pair of support portions 17.

In addition, the pair of support portions 17 and second support portions 19 may be molded integrally with the radiator 3, or may be separately provided and may be fixed to the first notch surface 3D. Furthermore, in the case of separately being formed, it is preferable to form the support portions using an insulation member.

The terminal board 7 is, for example, formed of a member having heat resistance such as resin, and, as shown in FIGS. 4 and 5, includes, a connect portion 7A for connecting connection lines 15 for power source supply and for dimming control extended from the lamp unit 6, and a connect portion 7B for connecting a power source cable for power source supply from the outside, a cable for dimming control or the like.

Furthermore, as shown in FIG. 5, on the attachment surface 7D of the terminal board 7, a pair of locking claw portions 7C is provided which is inserted into the engagement holes 17*a* formed in the pair of support portions 17, respectively.

The attachment of the terminal board 7 to the radiator 3 is performed by fitting the locking claw portion 7C of the attachment surface 7D of the terminal board 7 to the engagement hole 17*a* in the support portion 17 of the notch portion 3C. Then, the tip portion of the locking claw portion 7D of the terminal board 7 is engaged with the inner peripheral surface of the groove portion 18 of the radiator 3, whereby the terminal board 7 is fixed to the first notch surface 3D of the radiator 3 in the state where the attachment surface 7D comes into surface-contact with the tip surfaces of the pair of support portions 17 and support portions 19 (see FIG. 3). In addition, since the terminal board 7 is attached to the radiator 3 by the pair of support portions 17 and 19, the contact area of the attachment surface 7D of the terminal board 7 is small, and heat is not transmitted.

In the case of attaching the terminal board 7 to the radiator 3, a gap L (see FIG. 2) of the thickness of the support, portions 17 and 19, that is, a space portion 30 having an air layer corresponding to the gap L is formed between the attachment surface 7D of the terminal board 7 and the first notch surface 3D of the radiator 3.

The space portion 30 constitutes the insulation means. The space portion 30 as the insulation means insulates heat transmitted from the radiator 3 to the terminal board 7 such that the temperature transmitted from the radiator 3 to the terminal board 7 does not exceed the heat-resistant temperature of the power source cable when the lamp unit 6 is turned on.

Thus, the space portion 30 as the insulation means is formed, whereby, even if heat from the radiator 3 rapidly rises, since the air layer of the space portion 30 is interposed between the radiator 3 and the terminal board 7, it is possible to reduce heat transmitted to the terminal board 7 extremely by insulating heat from the radiator 3.

In addition, the description has been given of the space portion 30 having the air layer formed by the support portions 17 and 19 as the insulation means, but the luminaire 1 of the present embodiment also includes the space portion 31 that is formed by the groove portion 18 for attaching the locking claw portion 7C. That is, heat of the radiator 3 has the high temperature near the center thereof, and the temperature is lowered as getting closer to the outer peripheral side, for this reason, in addition to the space portion 30 formed on the outer peripheral side, the space portion 31 formed by the groove portion 18 provided on the center side of the radiator 3 behind the first notch surface 3D is formed, whereby it is further reduce heat transmitted to the terminal board 7.

Furthermore, the shape and the size of the groove portion 18 may be suitably changed as necessary, and may be formed so that a desired insulation effect can be obtained.

Furthermore, a configuration has been described in which the terminal board 7 is attached to the notch portion 3C of the radiator 3, but, for example, a pair of support portions 17 and 19 may be provided in the heat radiation fin 3*a* of the radiator 3 and the terminal board 7 may be attached to the heat radiation fin 3*a* via the support portions 17 and 19.

In addition, the description has been given of a case where the fixing method of the terminal board 7 and the radiator 3 is fixed by the locking claw portion 7C of the terminal board 7, but the fixing may be performed by the screwing of a screw or the like without being limited to it.

Next, the operation of the luminaire 1 of the present embodiment will be described.

In the luminaire 1 of the configuration mentioned above, as shown in FIG. 2, when the lamp is turned on, heat generated by the LED 8*a* in the lamp unit 6 is transmitted to the mount substrate 9 and the unit, main body 6A, and then is effectively transmitted to the bottom surface 3B of the radiator 3 with which the cam abutment surface 6C of the unit main body 6A comes into surface-contact. In the case of the luminaire 1 of high output, the amount of heat transmitted from the lamp unit 6 to the radiator 3 side is increased.

Moreover, the radiator 3 radiates the conducted heat. Even if the amount of heat transmitted from the lamp unit 6 to the radiator 3 side is increased, it is possible to promote the stabilization of the turn-on state of the lamp unit 6 by the heat radiation action of the radiator 3.

At this time, heat of the radiator 3 has the highest temperature near the center thereof due to the characteristics of the radiator 3, and the temperature is lowered the more radiator 3 gets closer to the heat radiation fin 3*a* of the outer peripheral side. More specifically, the temperature is lowered as getting away from the cap abutment surface 6C of the lamp unit 6 coming into surface-contact with the bottom surface 3B of the radiator 3. Moreover, the terminal board 7 is attached to the upper side of the radiator 3 on the lateral outside of the cap abutment surface 6C so that the position is away from the cap abutment surface 6C.

Thus, since the terminal board 7 is attached in a position where the temperature of the radiator 3 is the lowest, it is possible to sufficiently secure the tolerance of the power source cable or the like connected to the terminal board 7, whereby the power source cable or the like can be protected from heat.

Furthermore, the terminal board 7 is fixed to the notch portion 3C situated on the outer peripheral side having a lowered temperature via the space portion 30 that is the insulation means formed by the support portions 17 and 19.

Thus, even in a case where the temperature of the radiator 3 exceeds 70° C. that is the heat-resistant temperature of the power source cable or the like connected to the terminal board 7, by insulating heat transmitted to the terminal board 7 by the insulation action of the space portion 30, it is possible to sufficiently secure the tolerance of the power source cable or the like connected to the terminal board 7, whereby the power source cable or the like can be protected from heat.

Furthermore, it is possible to more strongly insulate heat transmitted to the terminal board 7 by the insulation action combined with the space portion 31 formed in the groove portion 18 as well as the insulation action of the space portion 30, whereby the power source cable or the like can be more effectively protected from heat.

Thus, according to the present embodiment, it is possible to realize the luminaire 1 which can protect the power source cable connected to the terminal board 7 from heat by insulating heat transmitted from the radiator 3 to the terminal board 7.

Modified Example 1

Figure 6:
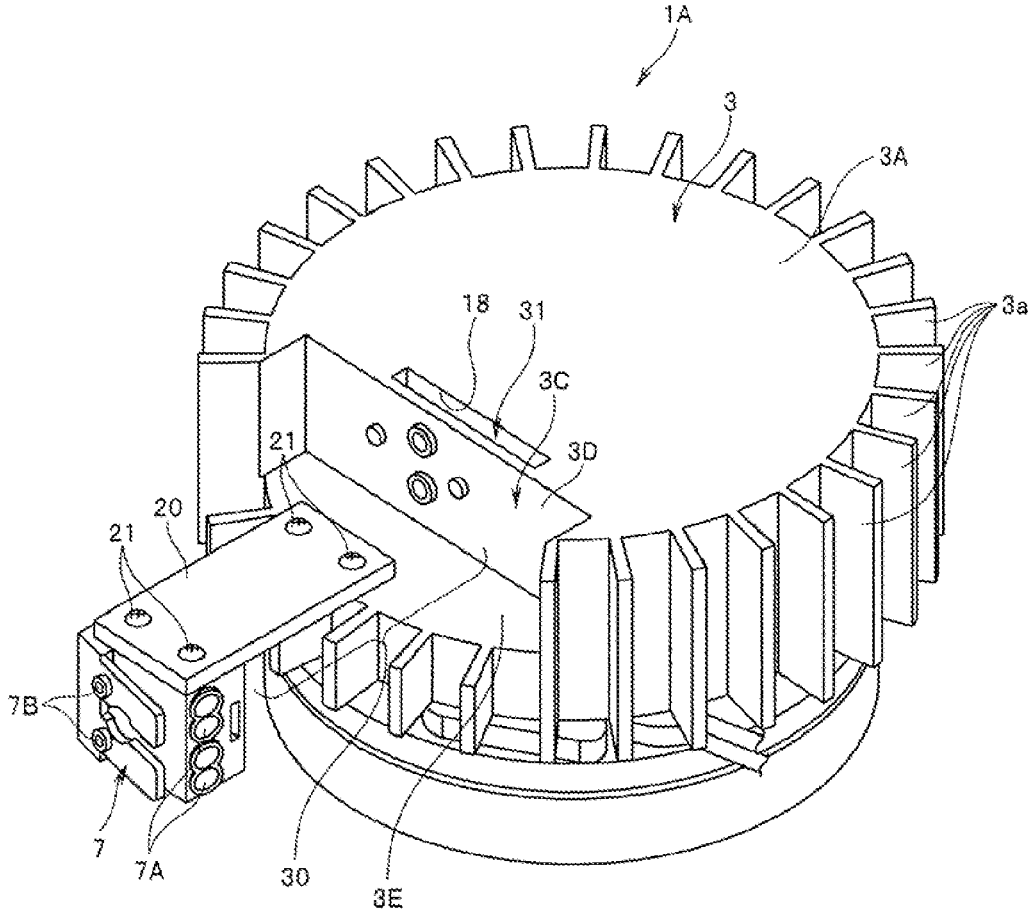
FIG. 6 is a perspective view for describing a modified example of an attachment structure of the terminal board relative to the radiator.

In addition, in the present embodiment, the attachment structure of the terminal board 7 to the radiator 3 is not limited to a configuration in the embodiment mentioned above, but the terminal board 7 may be attached to the radiator 3 in the configuration shown in the modified example of FIG. 6. The modified example will be described using FIG. 6.

FIG. 6 is a perspective view for describing a modified example of the attachment structure of the terminal board to the radiator. In addition, in FIG. 6, the same components as those of the luminaire 1 of the embodiment mentioned above will be denoted by the same reference numerals, the descriptions thereof will be omitted, and only the different portions will be described.

As shown in FIG. 6, a luminaire 1A is configured so that the terminal board 7 is attached to the radiator 3 using the insulation member 20 constituting the insulation means but the terminal board 7 is not attached to the radiator 3 via the support portions 17 and 19.

That is, the terminal board 7 is placed in the position of the outside behind the outer periphery of the radiator 3 on the cross section of the radiator 3 of the direction perpendicular to the attachment direction S of the lamp unit 6 to the radiator 3, and is attached via the insulation member 20 so as to form the space portion 30 having an air layer.

The insulation member 20 is, for example, formed in a plate shape using resin. Moreover, by attaching one end side of the insulation member 20 to the side surface of the terminal board 7 by the screwing of the screw 21 and attaching the other end side thereof to the second notch surface 3E of the notch portion 3C by the screwing of the screw 21, the terminal board 7 is fixed.

In addition, the other end of the insulation member 20 attached to the terminal board 7 may be attached to the third notch surface 3F by the screwing of the screw or the like. Furthermore, the shape and the length of the insulation member 20 may be suitably changed as necessary.

In addition, the terminal board 7 is attached so as to be a lower side with respect to the insulation member 20, but may be attached to the upper side. That is, in any attachment method, if the terminal board 7 is attached in a position separated from the outer periphery of the radiator 3 so as to form the space portion 30, the direction or the like of the terminal board 7 is not particularly limited.

Thus, according to the present modified example, by the insulation member 20 as the insulation means, the terminal board 7 is placed outside the outer periphery of the radiator 3 and is fixed so that the space portion 30 having the air layer is formed. Thus, heat is hardly transmitted to the terminal board 7 even in the embodiment mentioned above, whereby a more satisfactory insulation effect can be obtained.

Modified Example 2

Figure 7:
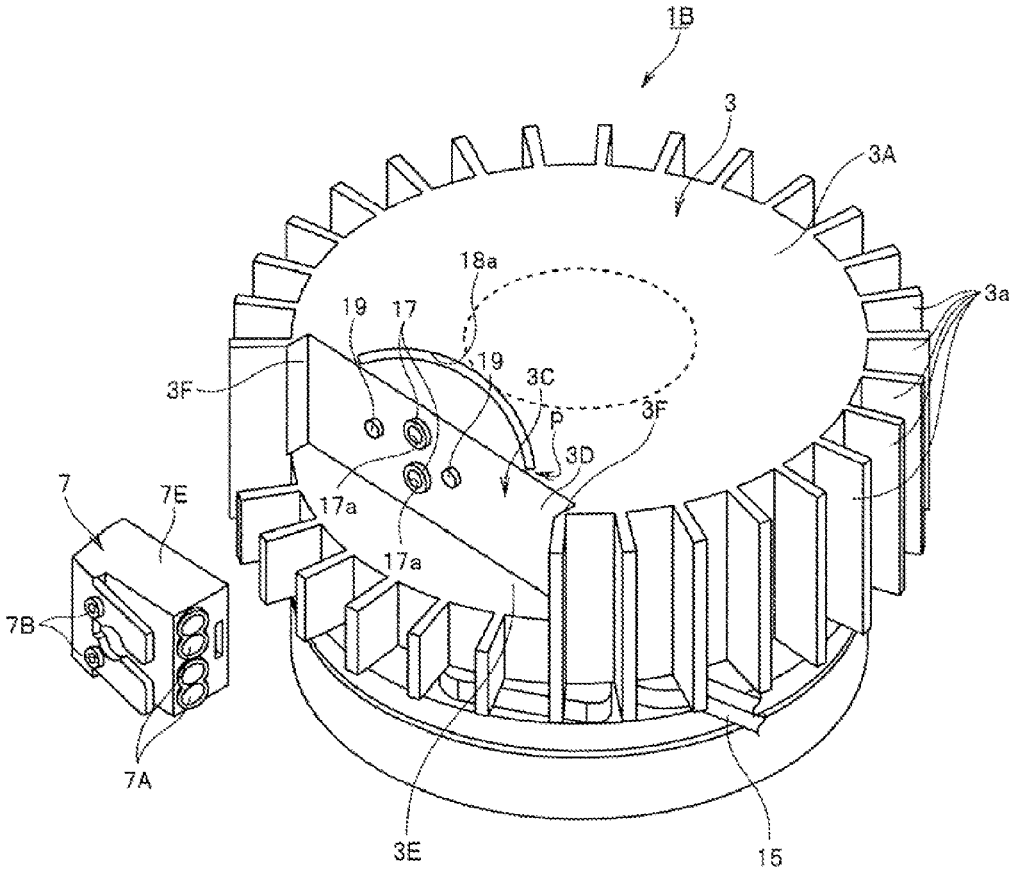
FIG. 7 is a perspective view for describing a modified example of a shape of a groove portion.

In addition, in the present embodiment, the shape of the groove portion 18 is not limited to the rectangular shape but may be a shape shown in a modified example of FIG. 7. Such a modified example will be described using FIG. 7.

FIG. 7 is a perspective view for describing the modified example of the shape of the groove portion. In addition, in FIG. 7, the same components as those of the luminaire 1 of the embodiment mentioned above will be denoted by the same reference numerals, the descriptions thereof will be omitted, and only the different portions will be described.

As shown in FIG. 7, a luminaire 1B is formed by the use of an arch-shaped groove 18*a* centered on the notch portion 3C side in place of the rectangular groove portion 18 of FIG. 4. The arc-shaped groove portion 18*a* is formed so as to reduce the heat transfer path P to the support portion 17 to which the terminal board 7 is attached. In this manner, by forming the groove portion 18*a* so as to reduce the heat transfer path P, it is possible to suppress the heat transfer of heat to the support portion 17 provided in the first notch surface 3D.

Thus, according to the present modified example, since the heat transfer path P to the terminal board 7 can be reduced by the arc-shaped groove portion 18*a*, heat is hardly transmitted to the terminal board 7 even in the embodiment mentioned above, whereby a more satisfactory insulation effect can be obtained.

Modified Example 3

Figure 8:
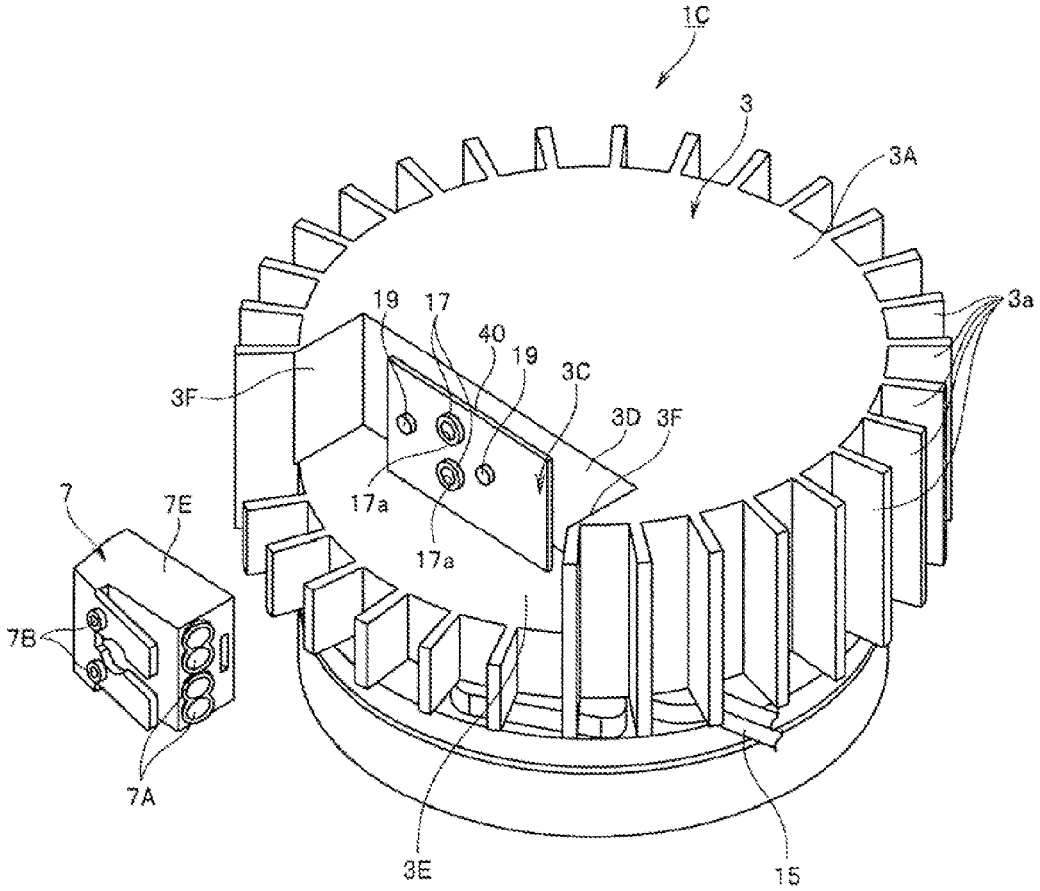
FIG. 8 is a perspective view for describing a modified example of the radiator.

In addition, in the present embodiment, the terminal board 7 has a configuration that is attached to the support portion 17 provided in the first notch surface 3D, but a configuration shown in the modified example of FIG. 8 may also be used. Such a modified example will be described by the use of FIG. 8.

FIG. 8 is a perspective view for describing a modified example of the radiator. In addition, in FIG. 8, the same components as those of the luminaire 1 of the embodiment mentioned above will be denoted by the same reference numerals, the descriptions thereof will be omitted, and only the different portions will be described.

As shown in FIG. 8, in a luminaire 1C, an attachment portion 40 is provided on the outside from the center of the radiator 3 of the first notch surface 3D. Moreover, the attachment portion 40 is provided with the support portions 17 and 19.

The attachment portion 40 has a plate shape, is formed integrally with the radiator 3, and is formed so as to protrude from the second notch surface 3E. Furthermore, the thickness of the attachment portion 40 having the plate shape is formed to be thinner than that of the heat radiation fin 3*a*. In the attachment portion 40, heat is not transmitted from the side but is only transmitted from the bottom surface. That is, the heat transfer path of heat is made only from the bottom surface of the attachment portion 40. Furthermore, the thickness of the attachment portion 40 is formed to be thinner than that of the heat radiation fin 3*a*, whereby the heat transfer path of the bottom surface is reduced.

Thus, according to the present modified example, by forming the attachment portion 40 of the plate shape thinner than the thickness of the heat radiation fin 3*a* so as to protrude from the second notch surface 3E, the heat transfer path to the terminal board 7 can be reduced. Thus, heat is hardly transmitted to the terminal board 7 even in the embodiment mentioned above, whereby a more satisfactory insulation effect can be obtained.

Modified Example 4

Figure 9:
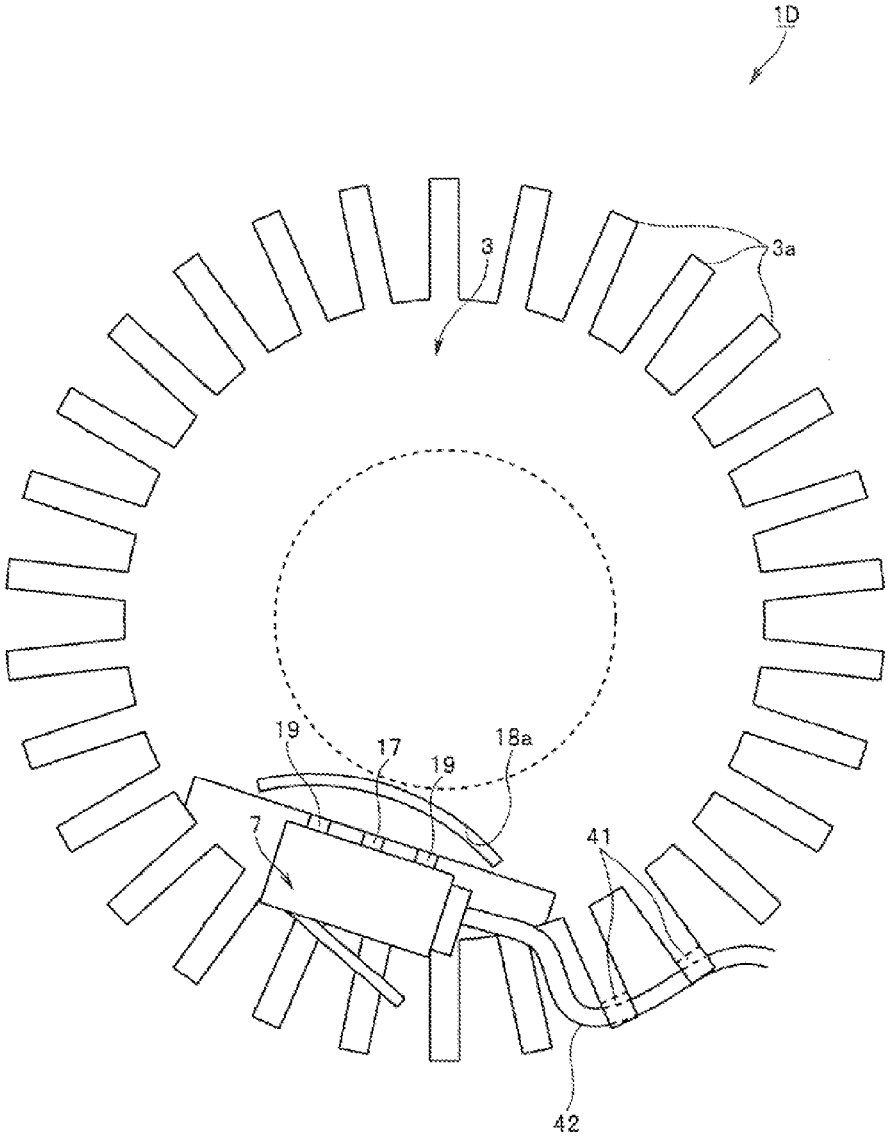
FIG. 9 is a top view for describing a modified example of the radiator.

In addition, in the present embodiment, the heat radiation fin 3*a* may be a configuration shown in a modified example of FIG. 9. Such modified example will be described using FIG. 9

FIG. 9 is a top view for describing a modified example of the radiator. In addition, in FIG. 9, the same components as those of the luminaire 1 of the embodiment mentioned above will be denoted by the same reference numerals, the descriptions thereof will be omitted, and only the different portions will be described.

As shown in FIG. 9, in a luminaire 1D, holding portions 41 are provided on tip sides of a plurality of (two, in the present example) heat radiation fins 3*a*, respectively. In addition, the luminaire 1D has a configuration in which the holding portions 41 are provided on the tip sides of two heat radiation fins 3*a*, respectively, but a configuration may be adopted in which the holding portions 41 are provided on the tip side one or three or more heat radiation fins 3*a*, respectively.

The holding portion 41 holds the power source cable for power source supply, the cable for dimming control or the like from the outside connected to the connect, portion 7B of the terminal board 7. In addition, in FIG. 9, the power source cable for power source supply or the like is shown as the power source cable 42.

In this manner, by providing the holding portion 41 on the tip side of the heat radiation fin 3*a* having the temperature lower than the center portion of the radiator 3 to hold the power source cable 42, it is to prevent that the power source cable 42 comes into contact with the portion having the temperature higher than that of the tip side of the heat radiation fin 3*a*, specifically, near the center of the upper portion of the radiator 3.

Thus, according to the present modified example, since it is possible to hold the power source cable 42 in the holding portion 41 having the temperature lower than that of the center portion provided on the tip side of the heat radiation fin 3*a*, it is possible to protect the power source cable 42 connected to the terminal board 7 from heat even in the embodiment mentioned above.

Modified Example 5

Figure 10:
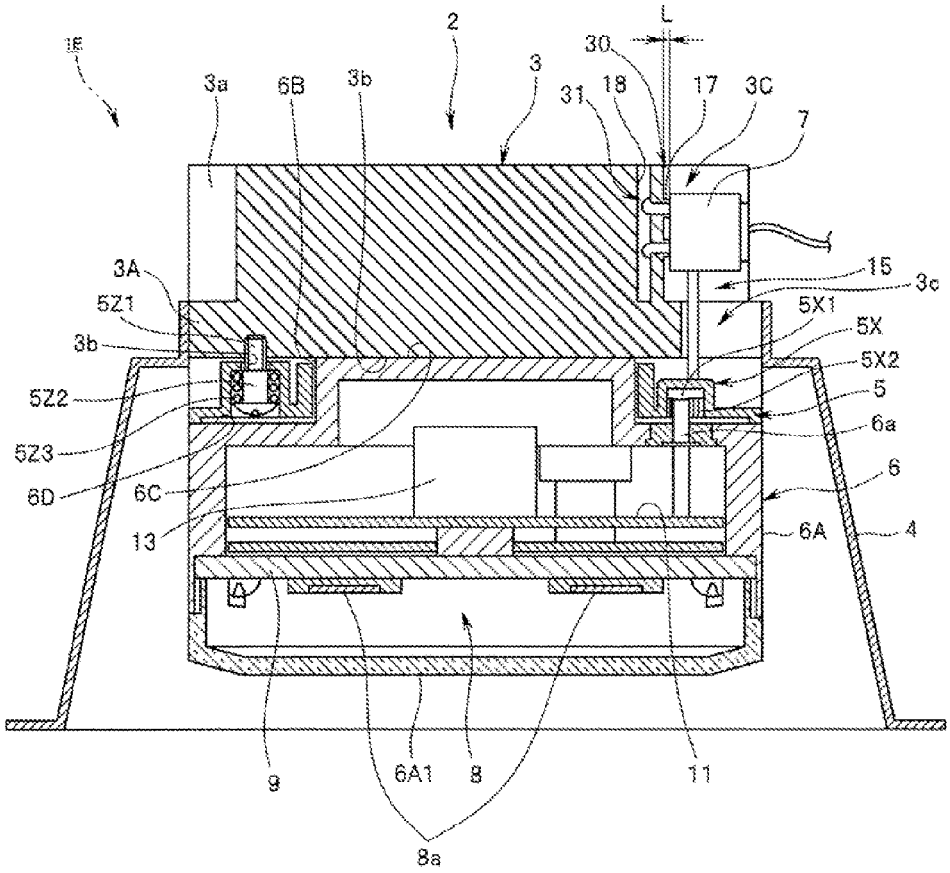
FIG. 10 is a cross-sectional view for describing a modified example of the radiator.

In addition, in the present embodiment, the radiator 3 may have a configuration shown in a modified example of FIG. 10. Such a modified example will be described by the use of FIG. 10.

FIG. 10 is a cross-sectional view for describing a modified example of the radiator. In addition, in FIG. 10, the same components as those of the luminaire 1 of the embodiment mentioned above will be denoted by the same reference numerals, the descriptions thereof will be omitted, and only the different portions will be described.

The radiator 3 is formed with a wiring groove 3*c* by notching a part, of the heat radiation main body 3A, and an upper surface side of the heat radiation main body 3A communicates with a bottom surface side thereof via the wiring groove 3*c*. A connection line 15 connecting the terminal board 7 with a socket portion for power source 5X is connected via the wiring groove 3*c*. That is, the connection line 15 has a configuration in which the terminal board 7 and the socket portion for power source 5X are connected to each other through the outside of the radiator 3. As a result, the influence of heat received by the connection board 15 from the radiator 3 is reduced.

Furthermore, when the terminal board 7 is attached to the radiator 3, the wiring groove 3*c* is provided just below the terminal board 7. Moreover, when the radiator 3 is attached to the lamp unit 6, the wiring groove 3*c* is provided just above the socket portion for power source 5X of the lamp unit 6. With such a configuration, it is possible to connect the terminal board 7 with the socket portion for power source 5X in the shortest way using the connection line 15 via the wiring groove 3*c*. As a result, the influence of heat received by the connection line 15 from the radiator 3 is reduced.

Thus, according to the present modified example, the connection line 15 can connect the terminal board 7 with the socket portion for power source 5X in the shortest way on the outside of the radiator 3, and thus, it is possible to protect the connection line 15 connecting the terminal board 7 with the socket portion for power source 5X from heat even in the embodiment mentioned above.

The present invention is not limited to the embodiments and the modified examples mentioned above, but various modifications, alterations or the like can be made within a scope which does not change the gist of the present invention.

The present invention is applied as a basis for claiming priority of Japanese Patent Application no. 2010-153439 filed on Jul. 5, 2010 in Japan, the contents of which are cited in the specification, the claims, and the drawings.

The invention claimed is:

1. A luminaire comprising:

a radiator includes a main body which is in surface-contact with an abutment surface of a lamp unit and configured to conduct heat generated by the lamp unit from the abutment surface through a center portion of the main body and then to an outer peripheral side of the main body such that during heat conduction, a temperature of the center portion is higher than a temperature of the outer peripheral side; and a terminal board which is attached to an upper outer peripheral side of the radiator.

2. The luminaire according to claim 1, wherein the terminal board is insulated from the main body.

3. The luminaire according to claim 2, wherein the main body is formed with a notch portion which has a protrusion-like support portion, and the terminal board is configured so that an attachment surface thereof is attached to the main body through the protrusion-like support portion, and the terminal board is insulated from the main body by a space portion which is formed between the attachment surface of the terminal board and the support portion.

4. The luminaire according to claim 2, wherein the terminal board is insulated from the main body by a groove portion which is provided between the terminal board and a center side of the main body.

5. The luminaire according to claim 3, further comprising:

an attachment portion which places the terminal board in a more outside position than the outer periphery of the radiator, and the terminal board is attached to the radiator through the attachment portion.

6. The luminaire according to claim 4, wherein the groove portion is an arc-shaped groove portion centered on the notch portion.

7. The luminaire according to claim 2, further comprising:

an attachment portion to which the terminal board is attached.

8. The luminaire according to claim 1, wherein the radiator has a plurality of heat radiation fins which radially extend from the outer periphery of the main body, and a holding portion, which holds a power source cable connected to the terminal board, is provided in at least one or more heat radiation fins of the plurality of heat radiation fins.

9. The luminaire according to claim 1, further comprising:

a wiring groove formed in the main body at a position facing the terminal board and facing a socket portion for power source of the lamp unit, and the terminal board and the socket portion for power source are connected by a connection line provided in the wiring groove.

* * * * *